US006663474B2

(12) United States Patent
Chen

(10) Patent No.: US 6,663,474 B2
(45) Date of Patent: Dec. 16, 2003

(54) APPARATUS AND SYSTEM OF CHEMICAL MECHANICAL POLISHING

(75) Inventor: Hai-Ching Chen, Tainan (TW)

(73) Assignee: United Microelectronics Corp., Hsin-Chu (TW)

( * ) Notice: Subject to any disclaimer, the term of this patent is extended or adjusted under 35 U.S.C. 154(b) by 90 days.

(21) Appl. No.: 09/811,687

(22) Filed: Mar. 19, 2001

(65) Prior Publication Data

US 2002/0132567 A1 Sep. 19, 2002

(51) Int. Cl.[7] ..... B24B 7/00

(52) U.S. Cl. ..... 451/72; 451/288; 451/443; 451/540; 451/125; 451/3; 451/8

(58) Field of Search ..... 451/28, 72, 285–290, 451/443, 540, 23, 56, 159, 163, 174; 125/3, 4, 8

(56) References Cited

U.S. PATENT DOCUMENTS 5,842,912 A * 12/1998 Holzapfel et al. ..... 125/3
5,913,714 A * 6/1999 Volodarsky et al. ..... 451/41
5,941,762 A * 8/1999 Ravkin et al. ..... 451/443
6,132,298 A * 10/2000 Zuniga et al. ..... 451/288
6,428,399 B1 * 8/2002 Tanabe et al. ..... 451/64

* cited by examiner

*Primary Examiner*—Joseph J. Hail, III
*Assistant Examiner*—Anthony Ojini
(74) *Attorney, Agent, or Firm*—Dickinson Wright PLLC

(57) ABSTRACT

Apparatus of carrier in a chemical mechanical polishing equipment comprises a carrier module for holding a wafer face down. A retaining ring and conditioning module is coupled to the carrier module, which is used for protecting the wafer edge against contact with a polishing pad in a deformed shape and executing a conditioning of the polishing pad. A first support module is coupled to the retaining ring and conditioning module, which is used for rotating, pressing down, and supplying conditioning chemicals for the retaining ring and conditioning module.

13 Claims, 3 Drawing Sheets

APPARATUS AND SYSTEM OF CHEMICAL MECHANICAL POLISHING

BACKGROUND OF THE INVENTION

1. Field of the Invention

The invention relates to chemical mechanical polishing equipment, and more particularly to apparatus of carrier in the chemical mechanical polishing equipment.

2. Description of the Prior Art

Fabrication of semiconductor integrated circuits (IC) is a complicated multi-step process creating microscope structures with various electrical properties to form a connected set of devices. As more layers are built up on the silicon wafer, problems caused by surface non-planarity become increasingly severe and can impact yield and chip performance. During the fabrication process, it may become necessary to remove excess material in a process referred to as planarization.

A common technique used to planarize the surface of a silicon wafer is CMP. CMP involves the use of a polishing pad affixed to a circular polishing table and a holder to hold the wafer face down against the rotating pad. A slurry containing abrasive and chemical additives are dispensed onto the polishing pad.

As depicted in FIG. 1, a CMP system 110 typically consists of a carrier module 120, a support module 130, a polishing pad module 140, and a conditioning module 150. Typically a polishing pad on the circular polishing table in the polishing pad module 140 is comprised of blown polyurethane with a felt surface layer containing many small pores to facilitate the flow of slurry to beneath the wafer being polished. The carrier module 120 provides the holder to hold the wafer face down against the rotating pad. Typically a retaining ring 125 in the carrier module 120 can prevent the wafer edge against contact with the polishing pad in a deformed shape.

On the other hand, the support module 130 comprises a rotation system 132, a pressure system 134 and a chemical system 136. The rotation system 132 is used for the rotation motion of the carrier module 120. The pressure system 134 is used for providing the down force of the carrier module 120 to keep the wafer in contact with the polishing pad. The chemical system 136 is responsible for supply of the slurry containing abrasive and chemical additives. Furthermore, the conditioning module 150 comprises a conditioning chemical system 154 and a robot system 155. The conditioning chemical system is responsible for the supply of the conditioning solution. The robot system 155 is used to the mechanical motion during conditioning process.

It is very important for the CMP system 110 to provide the smooth-changed and controllable polishing rate. However, the typical CMP system 110 only maintains the polishing rate in either ex-situ or non-real-time-in-situ pad conditioning, that is, the pad conditioning step can't be simultaneously implemented with the polishing step. Such an architecture may not fulfill the further shrunk IC design and manufacture. On the other hand, there is occupied space for the conditioning module, that causes the higher consumption of the CMP system in a semiconductor manufacture factory.

SUMMARY OF THE INVENTION

It is an object of the present invention to provide apparatus of carrier and a system of chemical mechanical polishing. A retaining ring combined with the conditioning function can provide activating pad and polishing wafer real-in-situ.

It is another object of the present invention to provide apparatus of carrier and a system of chemical mechanical polishing. A retaining ring made of the material of the conventional conditioner can be controlled with independent rotation motion and down-force supply.

In the present invention, apparatus of carrier in chemical mechanical polishing equipment comprises a carrier module for holding a wafer face down. A retaining ring and conditioning module is coupled to the carrier module, which is used for protecting the wafer edge against contact with a polishing pad in a deformed shape and executing a conditioning of the polishing pad while the wafer is being polished. A first support module is coupled to the retaining ring and conditioning module, which is used for rotating, pressing down, and supplying conditioning chemicals for the retaining ring and conditioning module.

BRIEF DESCRIPTION OF THE DRAWINGS

A better understanding of the invention may be derived by reading the following detailed description with reference to the accompanying drawing wherein.

DESCRIPTION OF THE PREFERRED EMBODIMENT

While the invention is described in terms of a single preferred embodiment, those skilled in the art will recognize that many modules described below can be altered and that species and types as well as other substitutions can be freely made without departing from the spirit and scope of the invention.

Furthermore, there is shown a representative portion of a system of the present invention in enlarged, the drawings are not necessarily to scale, as the modules are shown for clarify of illustration and should not be interpreted in a limiting sense.

In the present invention, a system of chemical mechanical polishing comprises a carrier module comprising a holder for holding a wafer face down. A polishing pad module comprising a polishing pad is used for providing a motion and a mount of the polishing pad. A retaining ring and conditioning module is coupled to the carrier module, which is used for protecting the wafer against contact with the polishing pad and executing a conditioning of the polishing pad. A first support module is coupled to the retaining ring and conditioning module, which is used for rotating, pressing down, and supplying conditioning chemicals for the retaining ring and conditioning module. A second support module is coupled to the carrier module, which is used for rotating, pressing down, and supplying polishing chemicals for the holder.

Figure 1:
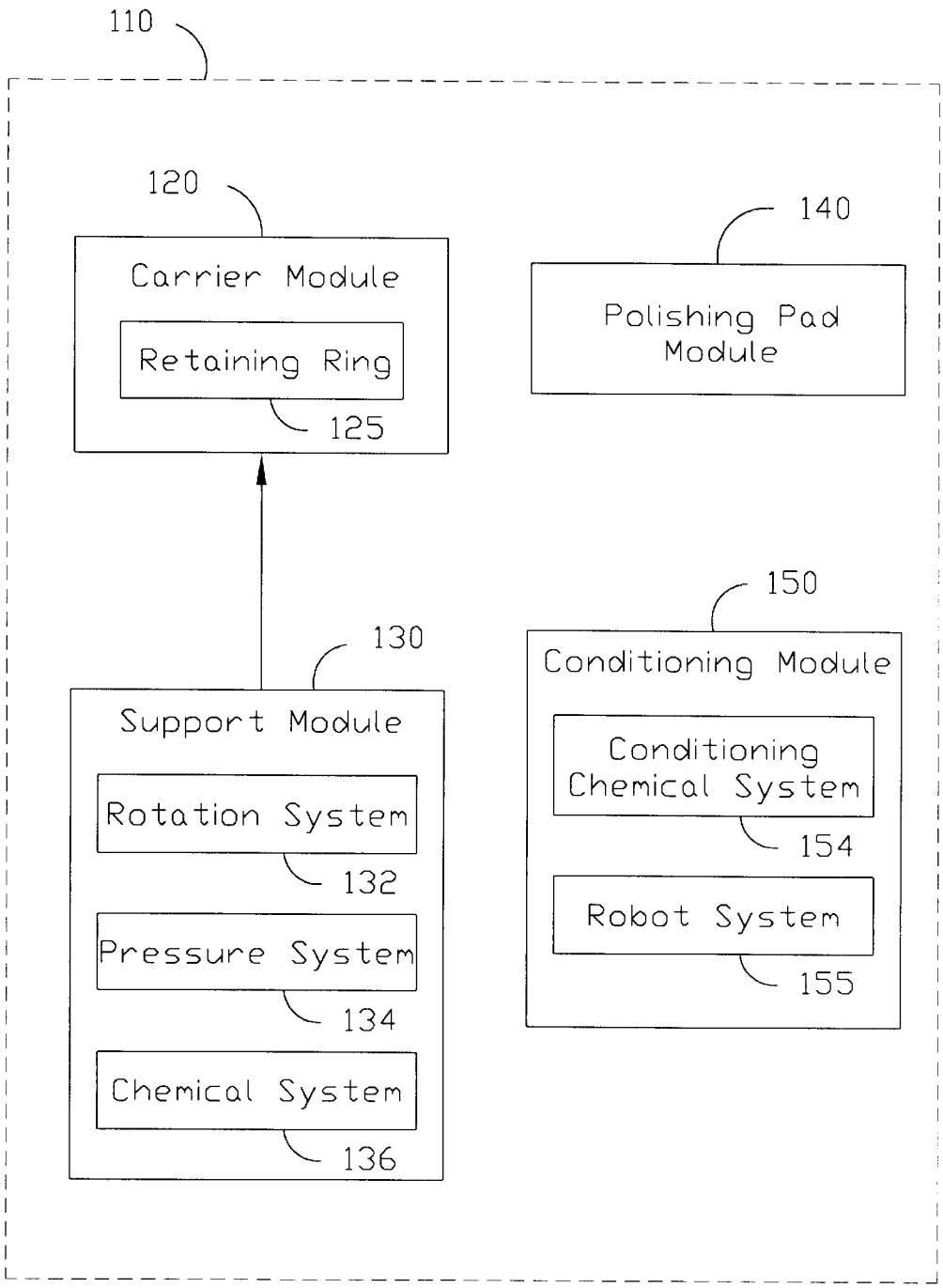
FIG.1(PRIOR ART)
FIG. 1 is a schematic diagram illustrating the architecture of a typical chemical-mechanical polishing system nowadays.
Figure 2:
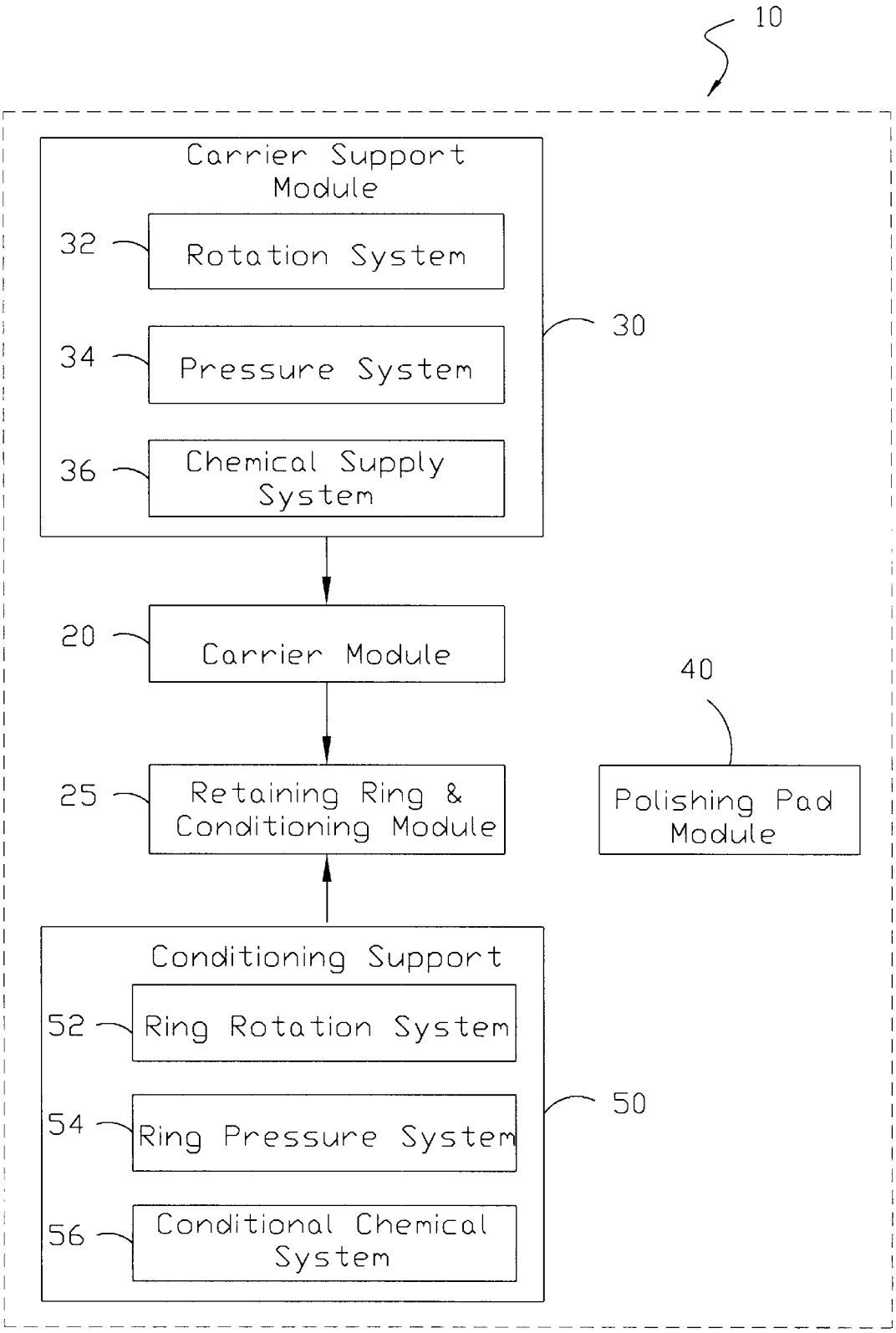
FIG. 2 is a schematic diagram illustrating the architecture of the chemical-mechanical polishing equipment in accordance with the present invention.

FIG.2 shows a schematic diagram illustrating the architecture of a CMP system in accordance with the present invention. A CMP system 10 consists of a carrier support module 30, a carrier module 20, a retaining ring and conditioning module 25, a conditioning support module 50, and a polishing pad module 40. The carrier module 20 consists of a related circuit and a holder for holding a wafer face down. The carrier support module 30 coupled to the carrier module 20 consists of a rotation system 32, a pressure supply system 34, and a chemical supply system 36. The rotation system 32 is responsible for the rotation motions of the holder in the carrier module 20 during a polishing process. The pressure supply system 34 provides down force for the wafer against a polishing pad. The chemical supply system 36 is responsible to provide polish-related chemical additives, such as slurry containing abrasive. The polishing pad module 40 consists of a polishing pad affixed to a linear or a rotational table.

A key of the present invention is the retaining ring and conditioning module 25. The retaining ring and conditioning module 25 plays roles on not only retaining but also conditioning. The retaining ring and conditioning module 25 consists of a retaining ring coupled to the carrier module 20. The retaining ring is made of the materials of the conventional conditioner, such as diamond planar grit, instead of ones of the conventional retaining ring, thus the retaining ring is referred as a conditioner. In order to offering suitable elasticity during the manufacture process, the material of the retaining ring is not restricted to the conventional materials of the conditioner. The advantage of the retaining ring combined with the function of the conditioner may occupy less space for the CMP system 10. It is because the robot system of the conventional conditioner can be abandoned.

On the other hand, the conditioning support module 50 is coupled to the retaining ring and conditioning module 25. A ring rotation system 54 and a ring pressure supply system 56 in the conditioning support module 50 are responsible for the rotation motions and down force supply of the retaining ring. The ring pressure supply system 56 can provide air or oil pressure to down the retaining ring. Thus, the rotation motions and the down force of the retaining ring are independent to the ones of the holder in the carrier module 20. Furthermore, a conditioning chemical system 56 is used to supply necessary chemicals during the conditioning procedure. The combination of the retaining ring and conditioning module 20 and the conditioning support module 50 are able to activate the polishing pad just adjacent to polishing the wafer (real-in-situ) and keep company with the wafer (real time). Furthermore, the constant polishing rate can be ensured by always keeping the polishing pad condition as at-beginning. One purpose of the present invention is to provide the retaining ring with additive function of the conditioner. The retaining ring, made of the materials of the conditioner, may execute the conditioning procedure. On the other hand, an independent support system different from one for the holder may provider the conditioning procedure to execute flexibly and well.

Figure 3:
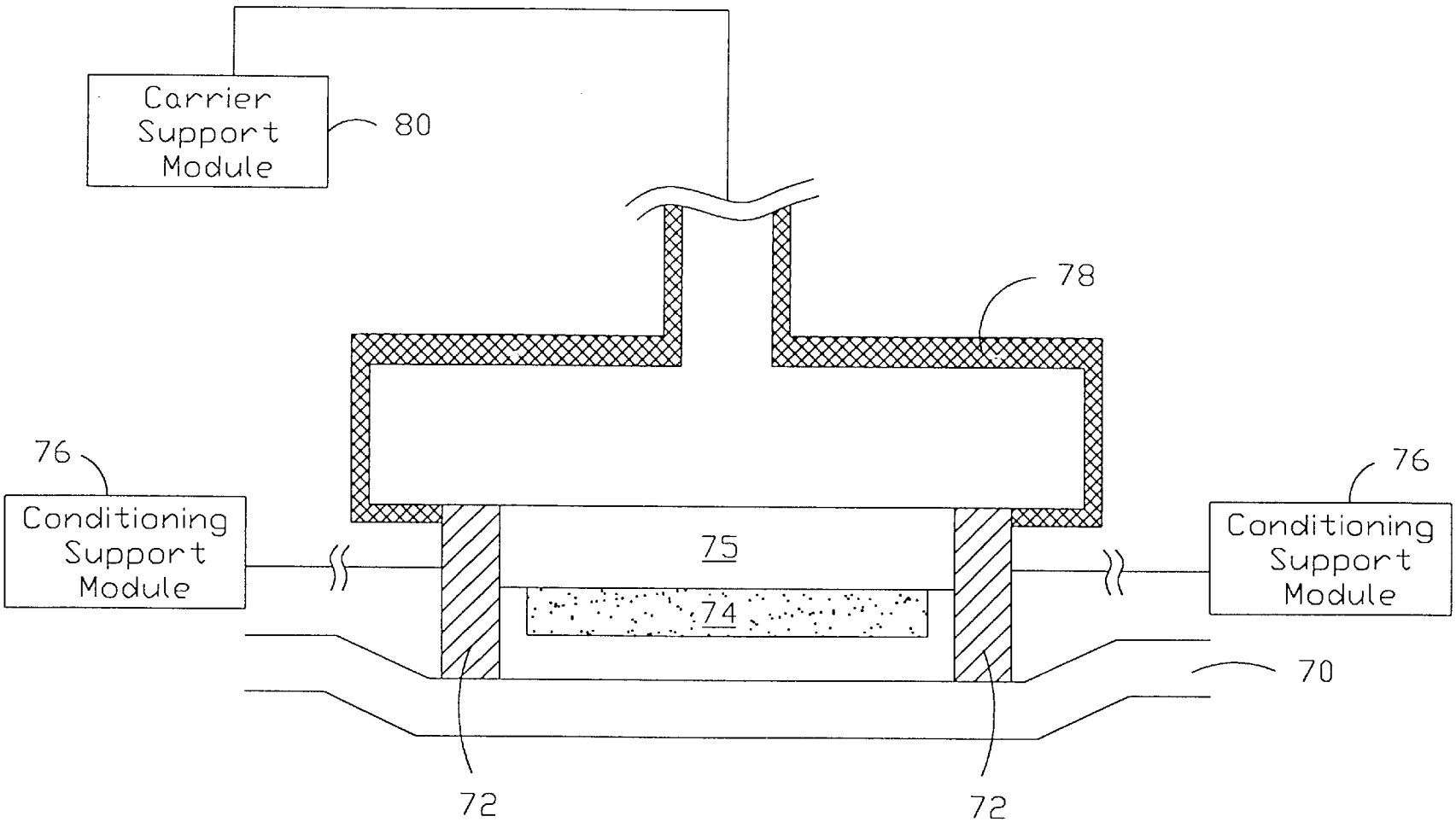
FIG. 3 is a cross sectional diagram illustrating a part of elements of the chemical-mechanical polishing equipment in accordance with the present invention.

FIG. 3 illustrates a cross sectional diagram of the chemical-mechanical polishing equipment in accordance with the present invention. A carrier module 78 consists of a holder 75 to hold a wafer 74. A retaining ring 72 is connected to a conditioning support module 76 for rotation motion, pressure supply, and conditioning chemicals supply of the retaining ring 72 of the present invention. The retaining ring 76 can keep contact with a polishing pad 70 and execute conditioning for the polishing pad 70. On the other hand, the carrier module 78 is connected to a carrier support module 80 for rotation motion, pressure supply, and polishing chemicals supply of the carrier module 78.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. Apparatus of carrier in a chemical mechanical polishing equipment, said apparatus comprising:

a carrier module for holding a wafer against a polishing pad, said carrier module being rotated by a first rotating system;

a retaining and conditioning module coupled to said carrier module and rotated independent to said carrier module, said retaining and conditioning module retaining said wafer and conditioning said polishing pad; and a conditioning support module coupled to said retaining and conditioning module, said conditioning support module rotating said retaining and conditioning module by using a second rotating system, providing said retaining and conditioning module with a down force against said polishing pad, and supplying conditioning chemicals.

2. The apparatus of claim 1 further comprising a polishing pad module for providing said polishing pad.

3. The apparatus of claim 1, wherein said carrier module comprises a holder for holding said wafer against said polishing pad.

4. The apparatus of claim 1, wherein said retaining and conditioning module comprises a retaining ring made of a material of diamond planar grit.

5. The apparatus of claim 1, wherein said conditioning support module further comprises:

a pressure supply system for providing said retaining and conditioning module with said down force against said polishing pad; and a conditioning supply system for supplying said conditioning chemicals.

6. The apparatus of claim 5, wherein said pressure supply system supplies oil pressure to provide said retaining and conditioning module with said down force.

7. Apparatus of carrier in a chemical mechanical polishing equipment, said apparatus comprising:

a carrier module for holding a wafer against a polishing pad;

a retaining and conditioning module coupled to said carrier module and rotated independent to said carrier module, said retaining and conditioning module retaining said wafer and conditioning said polishing pad;

a conditioning support module coupled to said retaining and conditioning module, said conditioning support module rotating said retaining and conditioning module by using a second rotating system, providing said retaining and conditioning module with a down force against said polishing pad, and supplying conditioning chemicals; and a carrier support module coupled to said carrier module, said carrier support module rotating said carrier module by using a first rotating system and providing polishing chemicals.

8. The system of claim 7, wherein said retaining and conditioning module comprises a retaining ring made of diamond planar grit.

9. The apparatus of claim 7, wherein said conditioning support module further comprises:

a pressure supply system for providing said retaining and conditioning module with said down force against said polishing pad; and a conditioning supply system for supplying said conditioning chemicals.

10. The apparatus of claim 9, wherein said pressure supply system supplies air pressure to provide said retaining and conditioning module with said down force.

11. The system of claim 7, wherein said carrier support system further comprises a polishing chemical system for supplying said polish chemicals.

12. The system of claim 7, wherein said motion of said polishing pad comprises a linear motion.

13. The system of claim 7, wherein said motion of said polishing pad comprises a rotating motion.

* * * * *